US010124497B2

(12) United States Patent
Galekovic

(10) Patent No.: US 10,124,497 B2
(45) **Date of Patent: *Nov. 13, 2018**

(54) FACIAL HAIR CLIPPINGS CATCHER

(71) Applicant: Nicholas Galekovic, Bal Harbour, FL (US)

(72) Inventor: Nicholas Galekovic, Bal Harbour, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/667,605

(22) Filed: Aug. 2, 2017

(65) Prior Publication Data

US 2017/0326740 A1 Nov. 16, 2017

Related U.S. Application Data

(63) Continuation of application No. 14/802,173, filed on Jul. 17, 2015.

(60) Provisional application No. 62/025,624, filed on Jul. 17, 2014.

(51) Int. Cl.

| | |
|---|---|
| ***B26B 19/38*** | (2006.01) |
| ***A45D 44/16*** | (2006.01) |
| ***A45D 44/08*** | (2006.01) |
| ***A45C 9/00*** | (2006.01) |
| ***A45D 27/00*** | (2006.01) |
| ***B26B 19/48*** | (2006.01) |

(52) U.S. Cl.

CPC ..... *B26B 19/3826* (2013.01); *A45C 9/00* (2013.01); *A45D 27/00* (2013.01); *A45D 44/08* (2013.01); *A45D 44/16* (2013.01); *B26B 19/3806* (2013.01); *B26B 19/48* (2013.01)

(58) Field of Classification Search

CPC ..... A45D 44/08; A45D 44/16; A45F 4/00; A41B 13/10

USPC ..... 2/50

See application file for complete search history.

(56) References Cited

U.S. PATENT DOCUMENTS 2,199,334 A * 4/1940 Ferry ..... A45D 44/08 2/50
2,351,666 A * 6/1944 Cohen ..... B65G 49/061 248/205.8
2,378,380 A * 6/1945 Brown ..... A41B 13/103 2/50
2,791,775 A * 5/1957 Sartell ..... A41D 15/04 2/69.5
3,796,366 A * 3/1974 Hahn ..... B05D 5/12 229/103.11
4,301,544 A * 11/1981 Burton ..... A41B 13/106 2/49.5
D275,827 S * 10/1984 Henry ..... D2/864
4,660,224 A * 4/1987 Ashcraft ..... A41B 13/10 2/48

(Continued)

*Primary Examiner* — Richale Quinn
*Assistant Examiner* — Anne Kozak
(74) *Attorney, Agent, or Firm* — Grant Attorneys at Law PLLC; Kristin A. Grant, Esq.

(57) ABSTRACT

A grooming-assisting device that replaceably attaches around the neck of a user, replaceably attaches to a mirror used by the user, and captures facial hair clipped from the user for disposal. The grooming-assisting device includes a substrate, a first attaching apparatus, and a second attaching apparatus. The substrate captures the facial hair clipped from the user for disposal. The first attaching apparatus extends from the substrate, and replaceably attaches the substrate around the neck of the user. The second attaching apparatus extends from the substrate, and replaceably attaches the substrate to the mirror used by the user.

5 Claims, 11 Drawing Sheets

(56) References Cited

U.S. PATENT DOCUMENTS 4,914,754 A * 4/1990 Ruth ..... A45D 19/18 2/171
5,054,124 A * 10/1991 Darvas ..... A45D 44/08 2/174
5,181,274 A * 1/1993 DeFiore ..... A41D 13/12 128/887
5,220,692 A * 6/1993 Cox ..... A41D 13/04 2/46
5,483,701 A * 1/1996 Ferreyros ..... A41B 13/103 2/247
5,530,968 A * 7/1996 Crockett ..... A41B 13/103 2/243.1
5,708,982 A * 1/1998 Armani ..... A45D 8/40 2/171
5,799,336 A * 9/1998 Cooper ..... A41B 13/103 2/247
5,953,753 A * 9/1999 Perez ..... A45D 44/08 2/48
5,956,763 A * 9/1999 Blackshear ..... A41B 13/106 2/46
6,131,197 A * 10/2000 Wang ..... A45D 44/08 132/212
6,131,865 A * 10/2000 Adams ..... A47G 1/17 248/205.5
6,308,923 B1 * 10/2001 Howard ..... F16B 47/00 248/205.5
D473,364 S * 4/2003 Conte ..... A41B 13/106 D2/860
7,237,271 B1 * 7/2007 McLandrich ..... A41B 13/106 2/49.1
8,151,370 B2 * 4/2012 Perazzo ..... A41B 13/103 2/49.1
8,763,181 B1 * 7/2014 Penfold ..... A47G 23/0306 5/420
2002/0144701 A1 * 10/2002 Leslie ..... A45D 44/08 132/212
2006/0143769 A1 * 7/2006 Pathak ..... A41D 13/04 2/48
2008/0201840 A1 * 8/2008 Hill ..... A47K 1/06 4/655
2008/0209612 A1 * 9/2008 Summers ..... A41D 15/04 2/84
2010/0325791 A1 * 12/2010 Davidowitz ..... A47K 1/06 4/655
2016/0066674 A1 * 3/2016 Szabo ..... A45D 44/08 2/50

* cited by examiner

FACIAL HAIR CLIPPINGS CATCHER

CROSS REFERENCE TO RELATED APPLICATIONS

This application claims the benefit of priority of U.S. Provisional Patent Application Ser. No. 62/025,624, filed Jul. 17, 2014. This application is a continuation of U.S. patent application Ser. No. 14/802,173 filed Jul. 17, 2015. Both of the above applications are incorporated by reference herein.

BACKGROUND

Field of the Invention

The present invention relates generally to a grooming—assistance device, and more specifically to a grooming-assistance device for replaceably attaching around the neck of a user, for replaceably attaching to a mirror, and for capturing facial hair clipped from the user for disposal.

Description of Related Art

Many men prefer to have facial hair, such as mustaches or beards, and well-groomed men keep their facial hair trimmed and neat in appearance. Self-grooming is generally accomplished using scissors and a mirror. Since mirrors are widely available in bathrooms, typically mounted above a sink, men often use these bathroom mirrors to trim their mustaches or beards, and use the sink to catch the falling trimmings. These falling trimmings spread untidy conditions over a wide area in, and around, the sink causing time-consuming clean-up, clogged drains, and messy conditions for the next user of the area.

There exists a need for a grooming-assistance device for replaceably attaching around the neck of a user, for replaceably attaching to a mirror used by the user, and for capturing facial hair clipped from the user for disposal so as to reduce the effort required to clean facial hair clippings after grooming thereby allowing for an easy disposal method that results in decreased effort, increased cleanliness, and no clogged drains.

Numerous innovations for protective drapes have been provided in the prior art, which will be described below in chronological order to show advancement in the art. Even though these innovations may be suitable for the specific individual purposes to which they address, they differ from the embodiments of the present invention in that they do not teach a grooming-assistance device for replaceably attaching around the neck of a user, for replaceably attaching to a mirror used by the user, and for capturing facial hair clipped from the user for disposal.

(1) U.S. Pat. No. 590,991 to Lenhart

U.S. Pat. No. 590,991—issued to Lenhart on Oct. 5, 1897—teaches a bib including a flexible body portion, spring-clamps attached directly to the flexible body portion at a lower end thereof whereby the bib is adapted to be secured directly to a table, and a distention rod having a hook secured to an upper end of the flexible body portion.

(2) U.S. Pat. No. 1,516,590 to Dorsey

U.S. Pat. No. 1,516,590—issued to Dorsey on Nov. 25, 1924—teaches a barber's apron including an elongated base having a slit and an upstanding and conical portion near one end thereof provided with a neck receiving opening. The sides of the slit are movable to lapped relation for the reception of a fastening apparatus. The apron, adjacent the slit, is adapted to rest on the shoulders of a wearer and incline downwardly therefrom in front of the wearer. The apron further includes a continuous peripheral wall surrounding the base. The wall increases in height from the end portion of the apron, adjacent the neck, to the other end thereof. The apron still further includes angular stiffening strips extending from under the base and up the wall and terminating upwardly adjacent the top of the wall. The apron yet further includes a reinforced bead surrounding the top of the wall.

(3) U.S. Pat. No. 4,689,830 to Williams

U.S. Pat. No. 4,689,830—issued to Williams on Sep. 1, 1987 in U.S. class 2 and subclass 50—teaches a hair cutting cape having a front funnel-shaped receptacle and a rear funnel-shaped receptacle for receiving hair clippings. The receptacles are unfolded to an open, flat, and non-retaining position. The entire periphery or margin of the cape is turned upwardly to direct hair clippings into one of the receptacles.

(4) United States Patent Application Publication Number US 2008/0083064 A1 to Litwhiler United States Patent Application Publication Number US 2008/0083064 A1 —published to Litwhiler on Apr. 10, 2008 in U.S. class 4 and subclass 657—teaches an absorbent or repellant material used to protect a wall or a mirror from splashes resulting from individuals washing their face, hands, hair, shaving, or brushing their teeth. The absorbent or repellant material is trapezoidal in shape, and includes a removable and wire-like apparatus located along the bottom edge and contained within a stitched seam wire-like pocket designed to mold along the back sink edge, behind faucet fixtures. At each top corner of the absorbent or repellant material is a typical eyelet/grommet apparatus including plastic or metal. The typical eyelet/grommet apparatus attaches to the mirror onto a typical suction cup hook or a typical cup hook.

(5) U.S. Pat. No. 7,509,688 B2 to Gregg

U.S. Pat. No. 7,509,688 B1—issued to Gregg on Mar. 31, 2009 in U.S. class 2 and subclass 50—teaches a facial hair trimmings catcher useful during personal grooming, which is collapsible or otherwise adapted for storing as a smaller unit. The catcher includes a bag having a closed bottom, closed side walls, and an open top, and further includes a support member that is attached to the side walls of the bag to form a support configuration. The support configuration supports the bag under the face of the user. The support member includes a support strap adapted for passing behind the neck of the user. The bag is held open by a flexible tension member extending around a top periphery as a frame or disposed as a frame for the side walls of the bag so that the bag is openable or collapsible.

(6) United States Patent Application Publication Number US 2010/0325791 A1 to Davidowitz United States Patent Application Publication Number US 2010/0325791 A1 —published to Davidowitz on Dec. 30, 2010 in U.S. class 4 and subclass 655—teaches a drape for maintaining a sanitary surface. The drape is made of a semi-rigid sheet of material. The semi-rigid sheet of material includes at least one temporary attachment point. The at least one temporary attachment point is disposed on substantially a first edge of the semi-rigid sheet of material. Additionally, the semi-rigid sheet of material includes at least one lip. The at least one lip is formed by a portion of the semi-rigid sheet of material. The lip is disposed at a second edge of the semi-rigid sheet of material.

It is apparent that numerous innovations for protective drapes have been provided in the prior art, which are adapted to be used. Furthermore, even though these innovations may be suitable for the specific individual purposes to which they address, they would not be suitable for the purposes of the present invention as heretofore described, namely, a grooming-assisting device for replaceably attaching around the neck of a user, for replaceably attaching to a mirror used by the user, and for capturing facial hair clipped from the user for disposal.

SUMMARY OF THE INVENTION

It is an object of the present invention to provide a grooming-assisting device for replaceably attaching around the neck of a user, for replaceably attaching to a mirror used by the user, and for capturing facial hair clipped from the user for disposal.

Briefly stated, another object of the present invention is to provide a grooming-assisting device that replaceably attaches around the neck of a user, replaceably attaches to a mirror used by the user, and captures facial hair clipped from the user for disposal. The grooming-assisting device includes a substrate, a first attaching apparatus and a second attaching apparatus. The substrate captures the facial hair clipped from the user for disposal. The first attaching apparatus extends from the substrate, and replaceably attaches the substrate around the neck of the user. The second attaching apparatus extends from the substrate, and replaceably attaches the substrate to the mirror used by the user.

The novel features considered characteristic of the embodiments of the present invention are set forth in the appended claims. The embodiments of the present invention, however, both as to their construction and to their method of operation together with additional objects and advantages thereof will be best understood from the following description of the specific embodiments when read and understood in connection with the accompanying figures of the drawing.

BRIEF DESCRIPTION OF DRAWINGS

Embodiments of the present invention will be described by way of example only, and not limitation, with reference to the accompanying drawings in which.

LIST OF REFERENCE NUMERALS UTILIZED IN THE FIGURES OF THE DRAWING

A. Introductory

Figure 1:
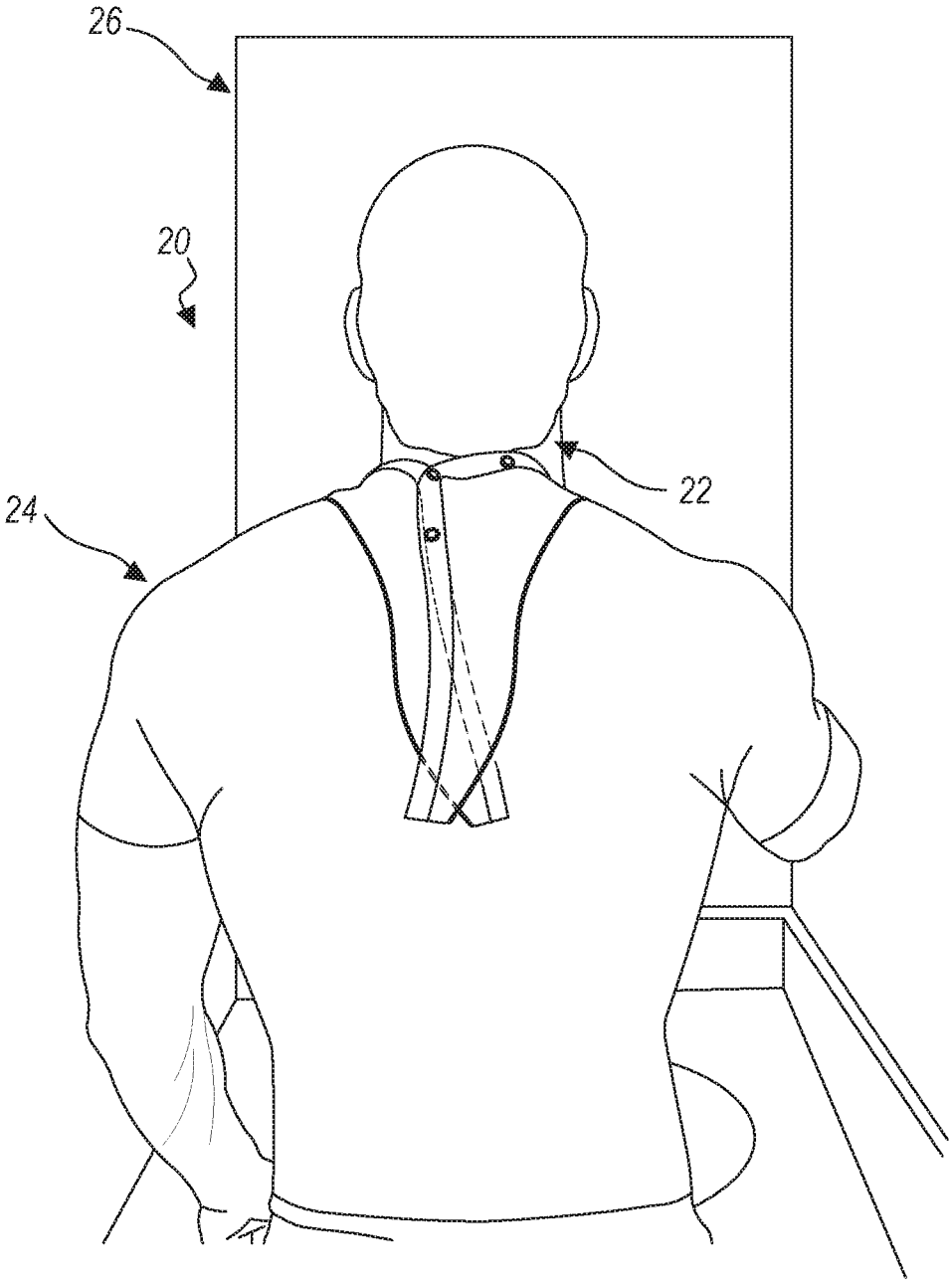
FIG. 1 is a diagrammatic rear perspective view of the grooming-assisting device of the embodiments of the present invention replaceably attached around the neck of a user.
Figure 2:
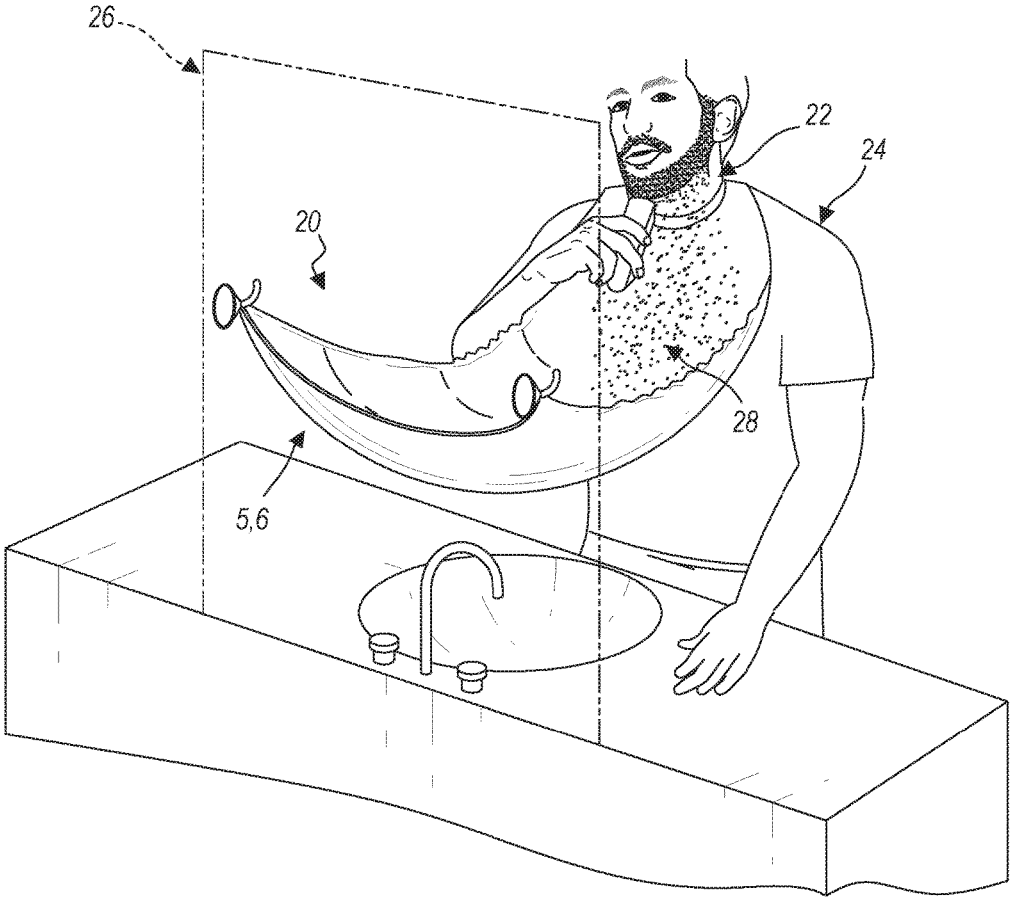
FIG. 2 is a diagrammatic front perspective view of the grooming-assisting device of the embodiments of the present invention replaceably attached around the neck of a user, replaceably attached to a mirror used by the user, and capturing facial hair clipped from the user.
Figure 3:
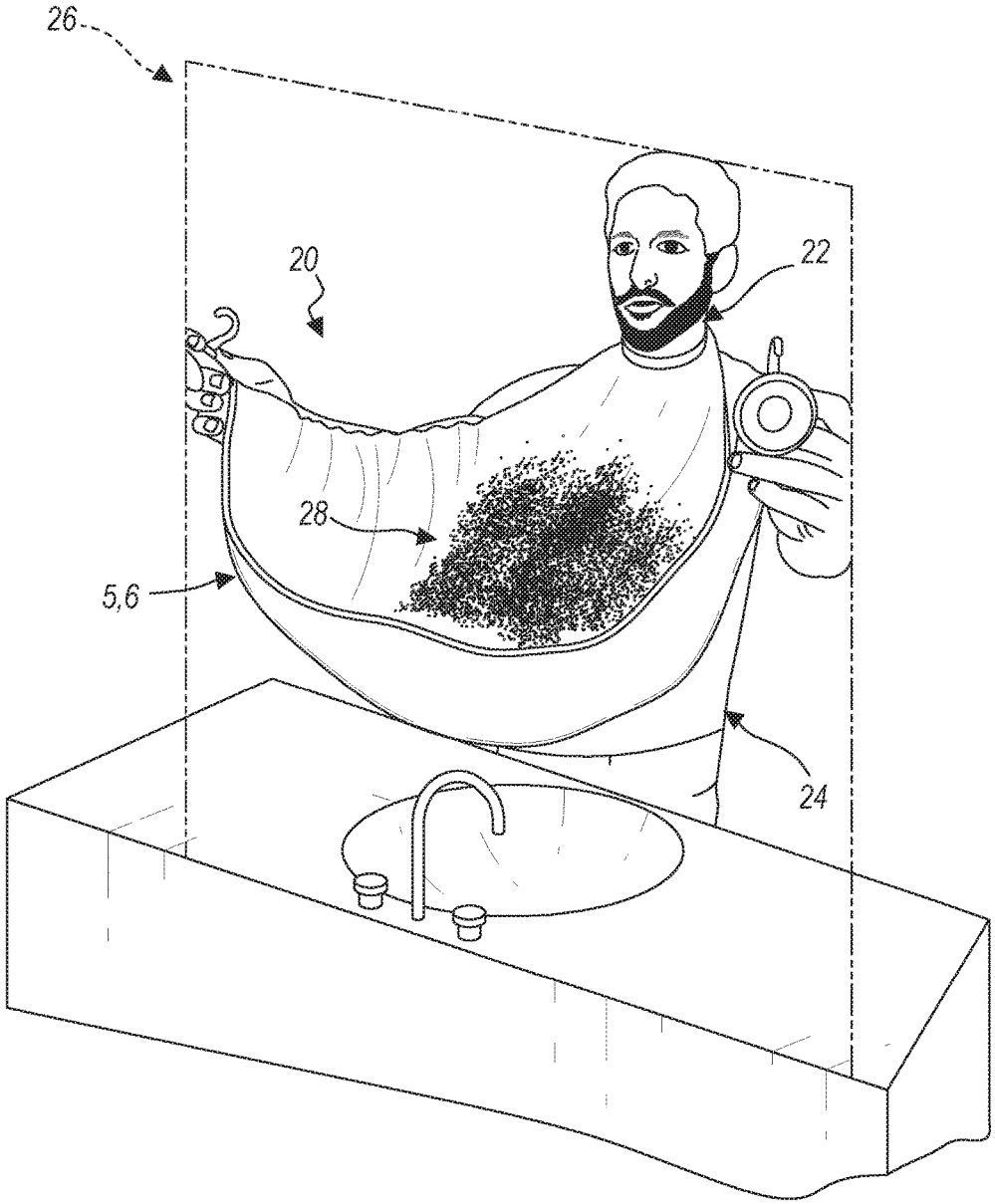
FIG. 3 is a diagrammatic front perspective view of the grooming-assisting device of the embodiments of the present invention replaceably attached around the neck of a user, being removed from a mirror used by the user, and capturing facial hair clipped from the user.

Grooming-assisting device 20 for replaceably attaching around neck 22 of user 24, for replaceably attaching to mirror 26 used by user 24, and for capturing facial hair 28 clipped from user 24 for disposal.

B. Overall Configuration of Grooming-Assisting Device 20

Substrate 30 for capturing facial hair 28 clipped from user 24 for disposal first attaching apparatus 32 for replaceably attaching substrate 30 around neck 22 of user 24 second attaching apparatus 34 for replaceably attaching substrate 30 to mirror 26 used by user 24.

C. Specific Configuration of Substrate 30

Flexible sheet 36 of substrate 30

Bottom edge 38 of flexible sheet 36 of substrate 30

Top edge 40 of flexible sheet 36 of substrate 30

Pair of side edges 42 of flexible sheet 36 of substrate 30

Working surface 44 of flexible sheet 36 of substrate 30 for capturing facial hair 28 clipped from user 24

Non-working surface 46 of flexible sheet 36 of substrate 30

Pair of upper corners 48 of flexible sheet 36 of substrate 30

Pair of lower corners 50 of flexible sheet 36 of substrate 30

Reinforcing member 52 of substrate 30 for providing flexible shoot for facilitating sliding of facial hair 28 clipped from user 24 off of flexible sheet 36 of substrate 30 during disposal Pair of strips 54 of substrate 30 for allowing user 24 freedom to move during use while tension still remains on flexible sheet 36 of substrate 30 still attached to mirror 26

Cut-out 56 of top edge 40 of flexible sheet 36 of substrate 30 for receiving neck 22 of user 24

Pair of free-ended neck flaps 58 of flexible sheet 36 of substrate 30 for wrapping around neck 22 of user 24

Pouch 60 of substrate 30

Mouth 62 of pouch 60 of substrate 30

Drawstring 64 of pouch 60 of substrate 30

D. Specific Configuration of First Attaching Apparatus 32

Neck strap 66 of first attaching apparatus 32 for comfort for neck 22 of user 24 during use Snaps 68 of first attaching apparatus 32 for allowing pair of free-ended neck flaps 58 of flexible sheet 36 of substrate 30 to be comfortably wrapped, and maintained, around different sized necks 22 of different users 24.

E. Specific Configuration of Second Attaching Apparatus 34

Pair of through bores 70 of pair of lower corners 50 of flexible sheet 36 of substrate 30, respectively Pair of lever-lock suction cups 72 of second attaching apparatus 34

Pair of lever hooks 74 of pair of lever-lock suction cups 72 of second attaching apparatus 34, respectively, for allowing pair of lever hooks 74 of pair of lever-lock suction cups 72 of second attaching apparatus 34, respectively, to face user 24 when pair of lever-lock suction cups 72 of second attaching apparatus 34 are affixed to mirror 26

Pair of loops 76 of second attaching apparatus 34 for allowing user 24 to pause and remove flexible sheet 36 of substrate 30 from mirror 26 without dropping any facial hair 28 clipped from user 24 and captured by flexible sheet 36 of substrate 30

DETAILED DESCRIPTION OF THE INVENTION

A. Introduction

Figure 4:
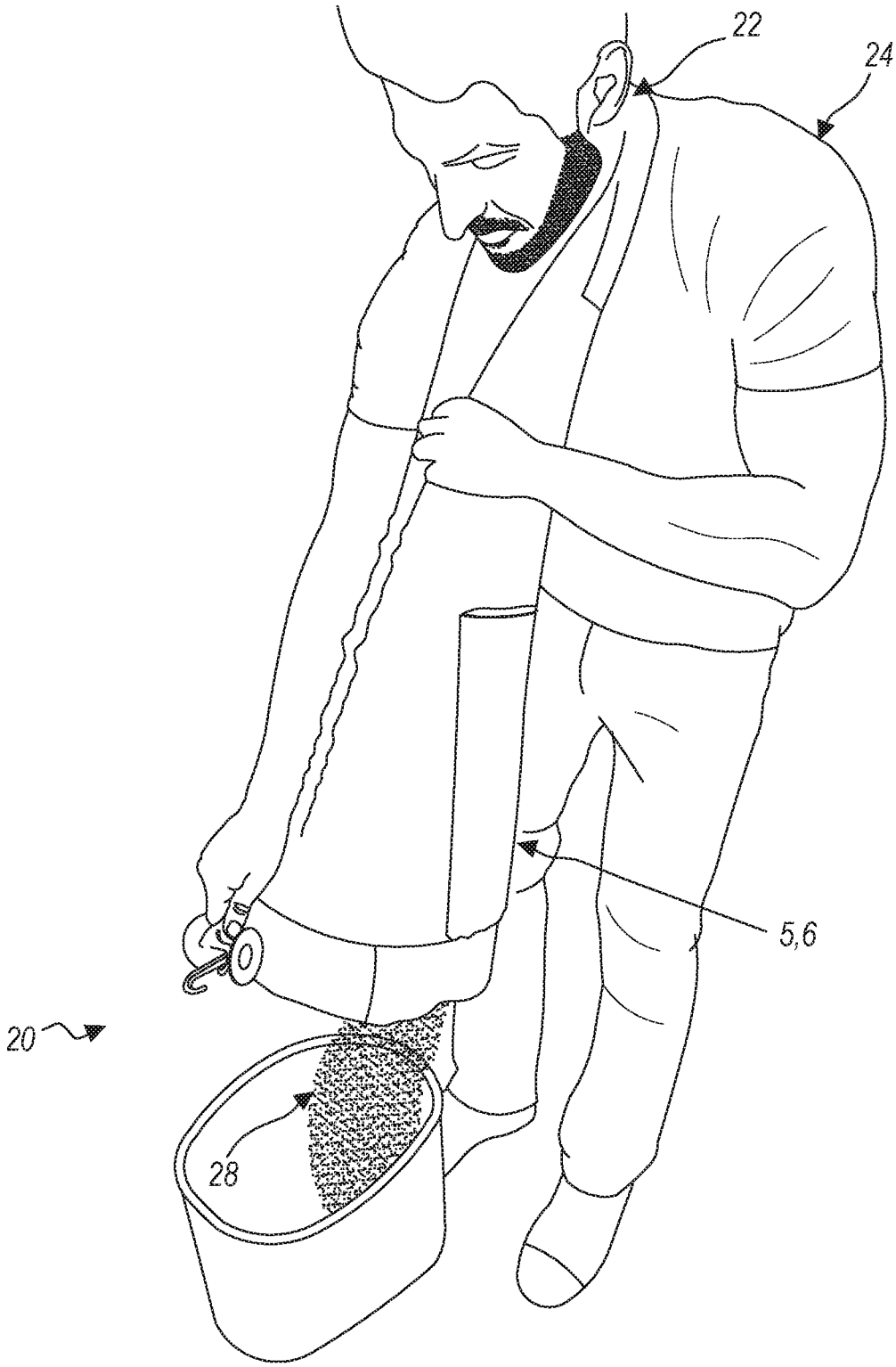
FIG. 4 is a diagrammatic front perspective view of the grooming-assisting device of the embodiments of the present invention replaceably attached around the neck of a user, removed from a mirror used by the user, and capturing facial hair clipped from the user for disposal.

Referring now to the figures of the drawing, in which like numerals indicate like parts, and particularly to FIGS. 1-4, the grooming-assisting device is shown generally at 20 for replaceably attaching around the neck 22 of a user 24 (FIGS. 1-4), for replaceably attaching to a mirror 26 used by the user 24 (FIGS. 2 and 3), and for capturing facial hair 28 clipped from the user 24 (FIGS. 2 and 3) for disposal (FIG. 4).

B. Overall Configuration of the Grooming-Assisting Device 20

Figure 5:
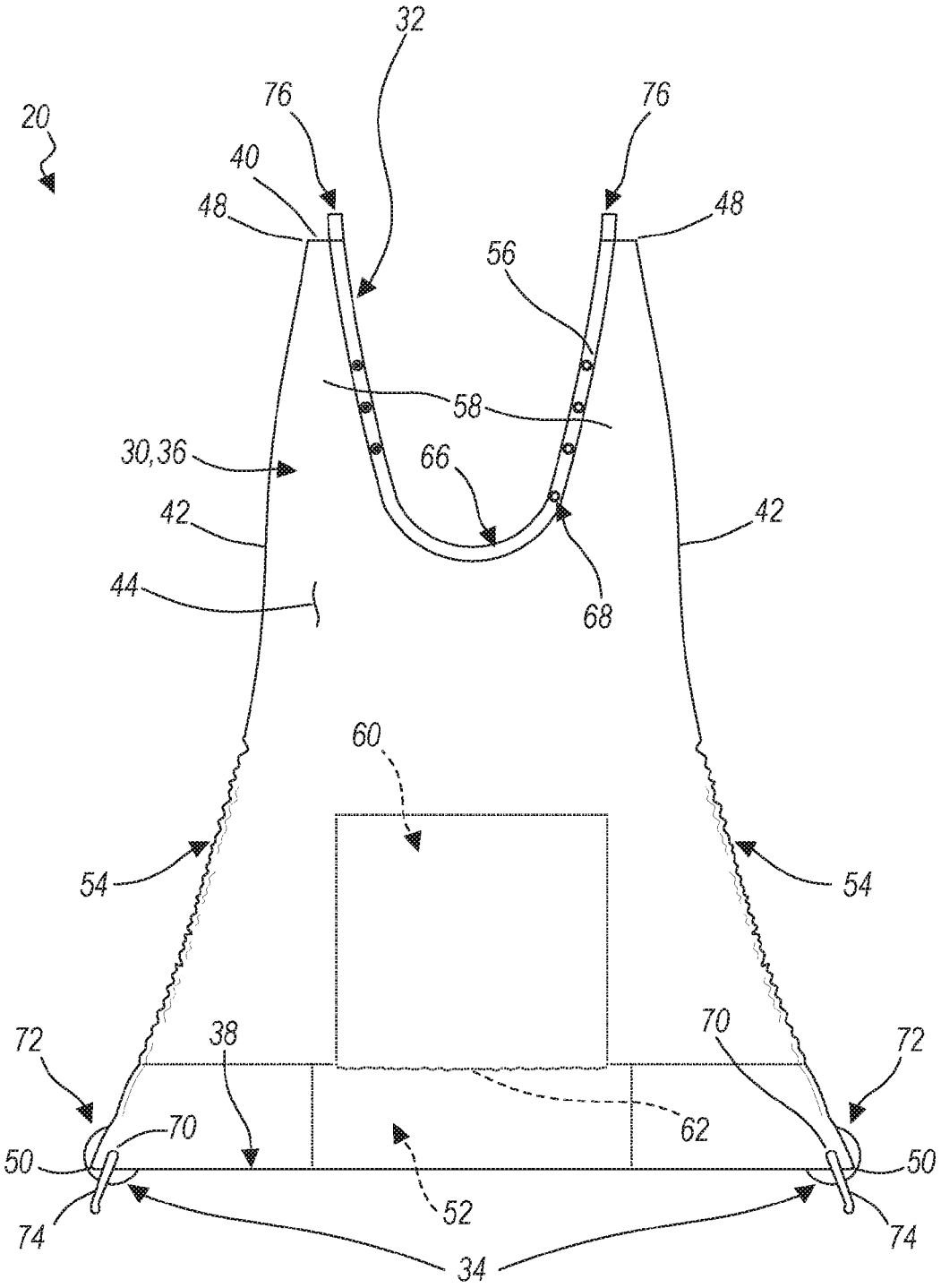
FIG. 5 is an enlarged diagrammatic elevational view of the grooming-assisting device of the embodiments of the present invention identified by ARROWS 5 in FIGS. 2-4.
Figure 6:
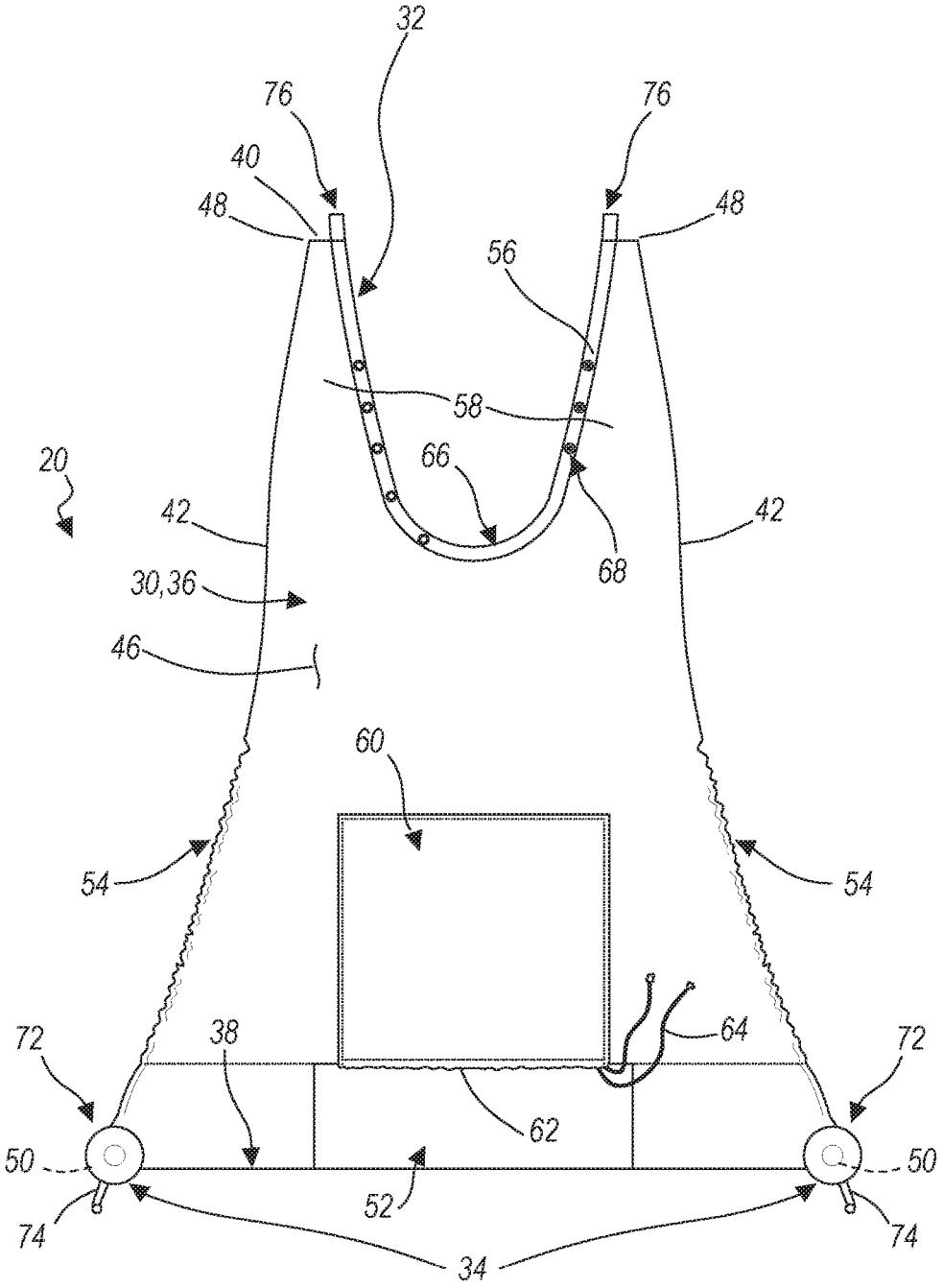
FIG. 6 is an enlarged diagrammatic elevational view of the grooming-assisting device of the embodiments of the present invention identified by ARROWS 6 in FIGS. 2-4.

The specific configuration of the grooming-assisting device 20 can best be seen in FIGS. 5 and 6, and as such, will be discussed with reference thereto.

The grooming-assisting device 20 comprises a substrate 30, a first attaching apparatus 32, and a second attaching apparatus 34. The substrate 30 is for capturing the facial hair 28 clipped from the user 24 for disposal. The first attaching apparatus 32 extends from the substrate 30, and is for replaceably attaching the substrate 30 around the 22 of the user 24. The second attaching apparatus 34 extends from the substrate 30, and is for replaceably attaching the substrate 30 to the mirror 26 used by the user 24.

C. Specific Configuration of the Substrate 30

The specific configuration of the substrate 30 can best be seen in FIGS. 5 and 6, and as such, will be discussed with reference thereto.

The substrate 30 comprises of a flexible sheet 36 made from a static-free/stick-free material for preventing the facial hair 28 clipped from the user 24 and captured thereon from sticking thereto. The flexible sheet 36 has a bottom edge 38, a top edge 40 that is shorter than the bottom edge 38, a pair of side edges 42 that converge upwardly from the bottom edge 38 to the top edge 40, a working surface 44 for capturing the facial hair 28 clipped from the user 24, a non-working surface 46, a pair of upper corners 48 disposed where the top edge 40 meets the pair of side edges 42, respectively, and a pair of lower corners 50 disposed where the bottom edge 38 of flexible sheet 36 meets the pair of side edges 42 of the flexible sheet 36, respectively.

The substrate 30 further comprises a reinforcing member 52. The reinforcing member 52 of the substrate 30 is rectangular-shaped, is disposed on the non-working surface 46 of the flexible sheet 36 of the substrate 30, is laterally oriented, and is flush with the bottom edge 38 of the flexible sheet 36 of the substrate 30.

The reinforcing member 52 of the substrate 30 is made from plastic for providing a flexible shoot for facilitating sliding of the facial hair 28 clipped from the user 24 off of the flexible sheet 36 of the substrate 30 during disposal.

The substrate 30 further comprises a pair of strips 54. The pair of strips 54 of the substrate 30 extend from the pair of lower corners 50 of the flexible sheet 36 of the substrate 30, partially up the pair of side edges 42 of the flexible sheet 36 of the substrate 30, respectively, and are made from elastic for allowing the user 24 freedom to move during use while tension still remains on the flexible sheet 36 of the substrate 30 still attached to the mirror 26. The top edge 40 of the flexible sheet 36 of the substrate 30 has a cut-out 56. The cut-out 56 of the top edge 40 of the flexible sheet 36 of the substrate 30 is U-shaped for receiving the neck 22 of the user 24, is disposed equally inwardly from the pair of upper corners 48 of the flexible sheet 36 of the substrate 30, and forms with upper portions of the pair of side edges 42 of the flexible sheet 36 of the substrate 30, which are free of the pair of strips 54 of the substrate 30, a pair of free-ended neck flaps 58 for wrapping around the neck 22 of the user 24.

The substrate 30 further comprises of a pouch 60. The pouch 60 of the substrate 30 is square-shaped, is disposed on the non-working surface 46 of the flexible sheet 36 of the substrate 30, opens downwardly to a mouth 62, is flush with, and extends upwardly from, the reinforcing member 52 of the substrate 30, and stores the grooming-assisting device 20 when not in use so as to allow the grooming-assisting device 20 to be self-storing, and be able to store any grooming items used by the user 24.

The pouch 60 of the substrate 30 further has a drawstring 64. The drawstring 64 of the pouch 60 of the substrate 30 extends around, and selectively closes, the mouth 62 of the pouch 60 of the substrate 30.

D. Specific Configuration of the First Attaching Apparatus 32

The specific configuration of the first attaching apparatus 32 can best be seen in FIGS. 5 and 6, and as such, will be discussed with reference thereto.

The first attaching apparatus 32 includes a neck strap 66. The neck strap 66 of the first attaching apparatus 32 extends along the cut-out 56 of the top edge 40 of the flexible sheet 36 of the substrate 30, and is made from nylon for comfort for the neck 22 of the user 24 during use. The first attaching apparatus 32 may further comprise of snaps 68. The snaps 68 of the first attaching apparatus 32 extending along the neck strap 66 of the first attaching apparatus 32, with male portions thereof extending along one portion of the neck strap 66 of the first attaching apparatus 32, and with female portions thereof extending along an opposite portion of the neck strap 66 of the first attaching apparatus 32, for allowing the pair of free-ended neck flaps 58 of the flexible sheet 36 of the substrate 30 to be comfortably wrapped, and maintained, around different sized necks 22 of different users 24.

In the alternative, however, the first attaching apparatus 32 may comprise of double-sided tape when the flexible sheet 36 of the substrate 30 is made from a lightweight disposable material. The double-sided tape of the first attaching apparatus 32 extending along one portion of the neck strap 66 of the first attaching apparatus 32 for allowing the pair of free-ended neck flaps 58 of the flexible sheet 36 of the substrate 30 to be comfortably wrapped, and maintained, around different sized necks 22 of different users 24.

E. Specific Configuration of the Second Attaching Apparatus 34

The specific configuration of the second attaching apparatus 34 can best be seen in FIGS. 5 and 6, and as such, will be discussed with reference thereto.

The second attaching apparatus 34 includes the pair of lower corners 50 of the flexible sheet 36 of the substrate 30 having a pair of through bores 70, respectively. The second attaching apparatus 34 further comprising a pair of lever-lock suction cups 72 having a pair of lever hooks 74, respectively. The pair of lever-lock suction cups 72 of the second attaching apparatus 34 are disposed on the non-working surface 46 of the flexible sheet 36 of the substrate 30, and are maintained thereat by the pair of lever hooks 74 of the pair of lever-lock suction cups 72 of the second attaching apparatus 34, respectively, passing through the pair of through bores 70 of the pair of lower corners 50 of the flexible sheet 36 of the substrate 30, respectively, for allowing the pair of lever hooks 74 of the pair of lever-lock suction cups 72 of the second attaching apparatus 34, respectively, to face the user 24 when the pair of lever-lock suction cups 72 of the second attaching apparatus 34 are affixed to the mirror 26.

In the alternative, the second attaching apparatus 34 may comprise of double-sided tape when the flexible sheet 36 of the substrate 30 is made from a lightweight disposable material. The double-sided tape of the second attaching apparatus 34 is disposed on the non-working surface 46 of the flexible sheet 36 of the substrate 30, at the pair of lower corners 50 of the flexible sheet 36 of the substrate 30.

The grooming-assisting device 20 may further comprise a pair of loops 76. The pair of loops 76 extending outwardly from the neck strap 66 of the first attaching apparatus 32, are disposed where the neck strap 66 of the first attaching apparatus 32 meets the top edge 40 of the flexible sheet 36 of the substrate 30, respectively, and selectively receive the pair of lever hooks 74 of the pair of lever-lock suction cups 72 of the second attaching apparatus 34, respectively, for allowing the user 24 to pause and remove the flexible sheet 36 of the substrate 30 from the mirror 26 without dropping any of the facial hair 28 clipped from the user 24 and captured by the flexible sheet 36 of the substrate 30.

F. Method of Self-Packing the Grooming-Assisting Device 20

The method of self-packing the grooming-assisting device 20 can best be seen in FIGS. 7-11, and as such, will be discussed with reference thereto.

Figure 7:
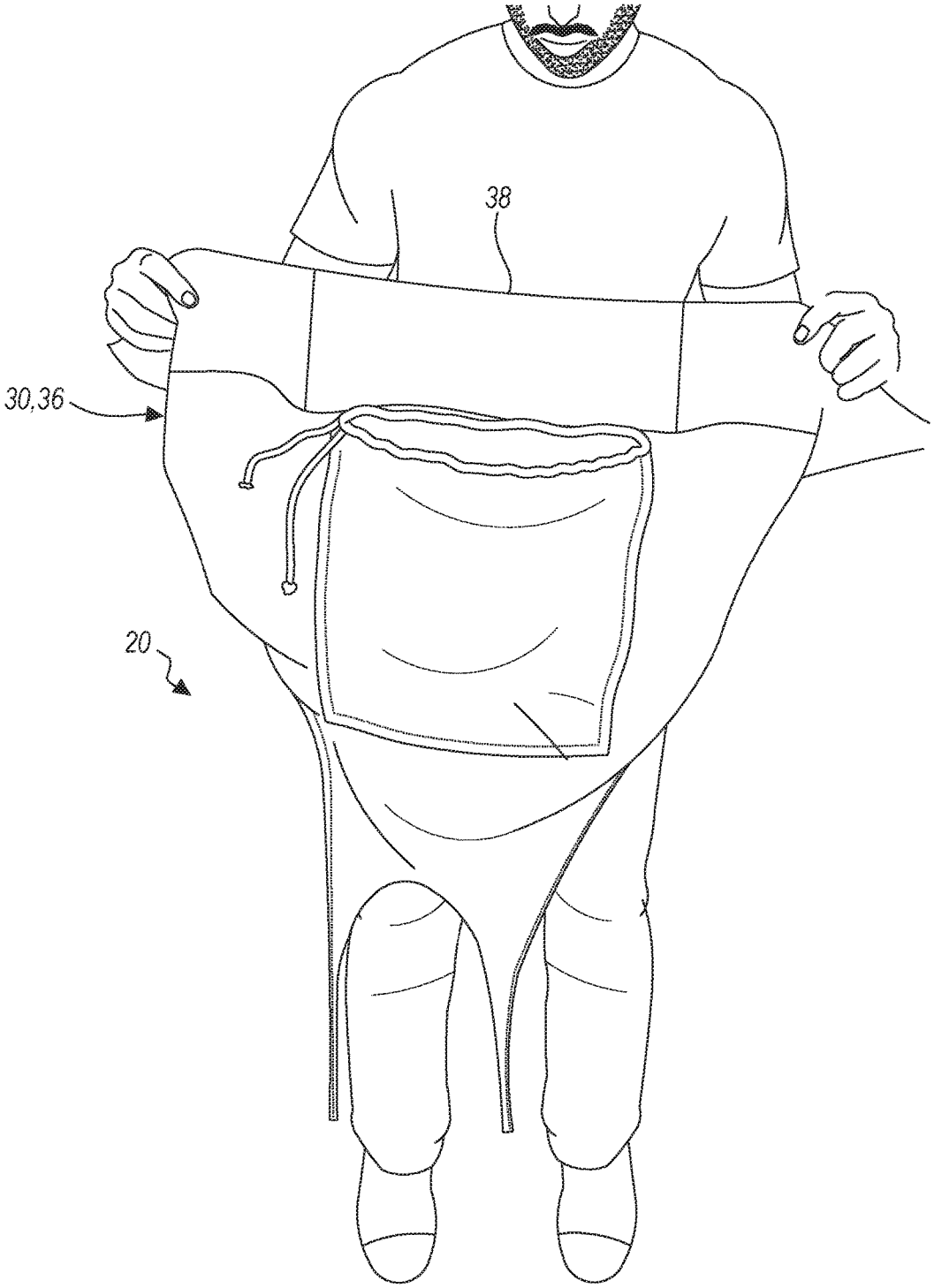
FIG. 7 is a diagrammatic perspective view of the first step of the method of self-packing the grooming-assisting device of the embodiments of the present invention.
Figure 8:
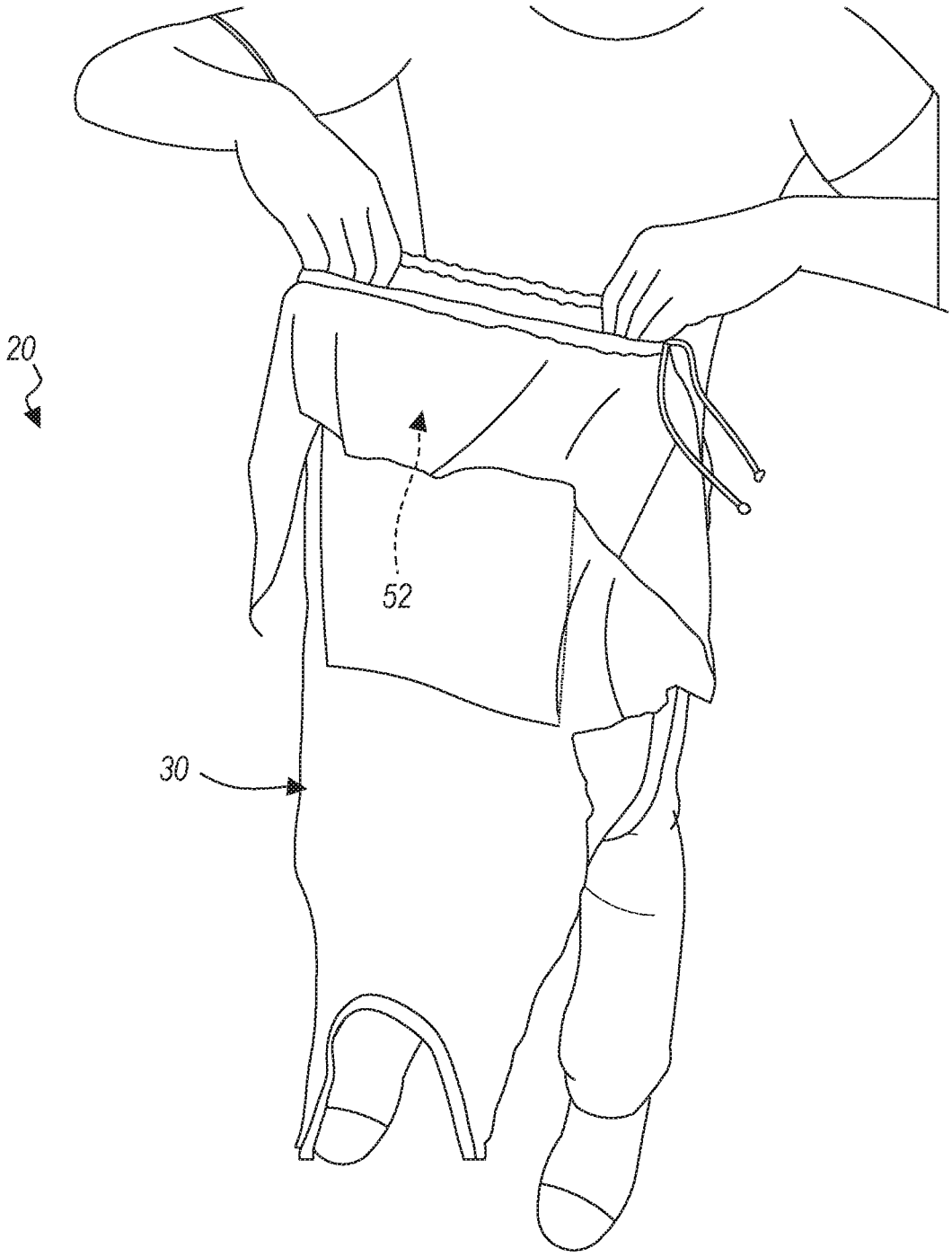
FIG. 8 is a diagrammatic perspective view of the second step of the method of self-packing the grooming-assisting device of the embodiments of the present invention.
Figure 9:
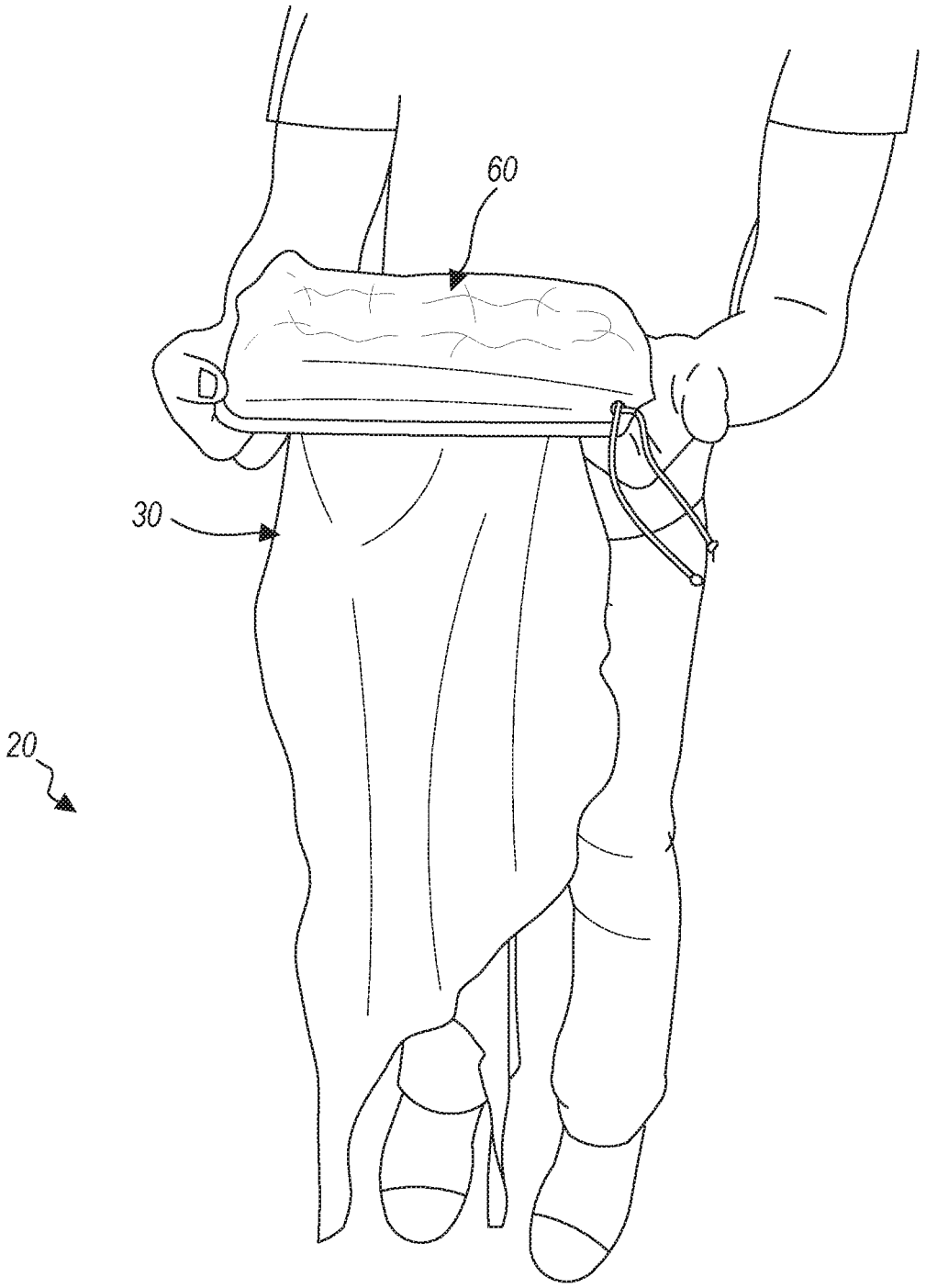
FIG. 9 is a diagrammatic perspective view of the third step of the method of self-packing the grooming-assisting device of the embodiments of the present invention.
Figure 10:
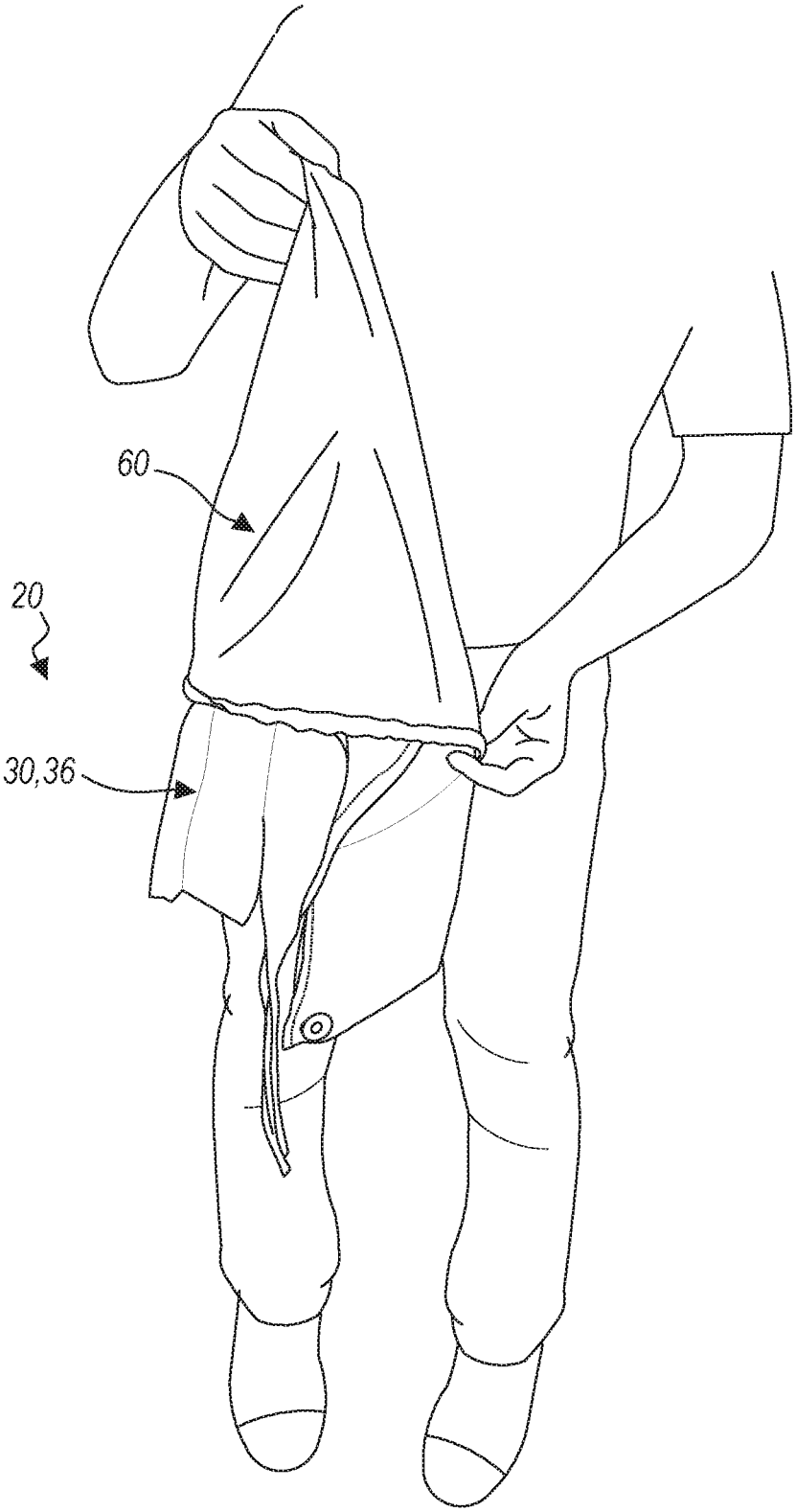
FIG. 10 is a diagrammatic perspective view of the fourth step of the method of self-packing the grooming-assisting device of the embodiments of the present invention.
Figure 11:
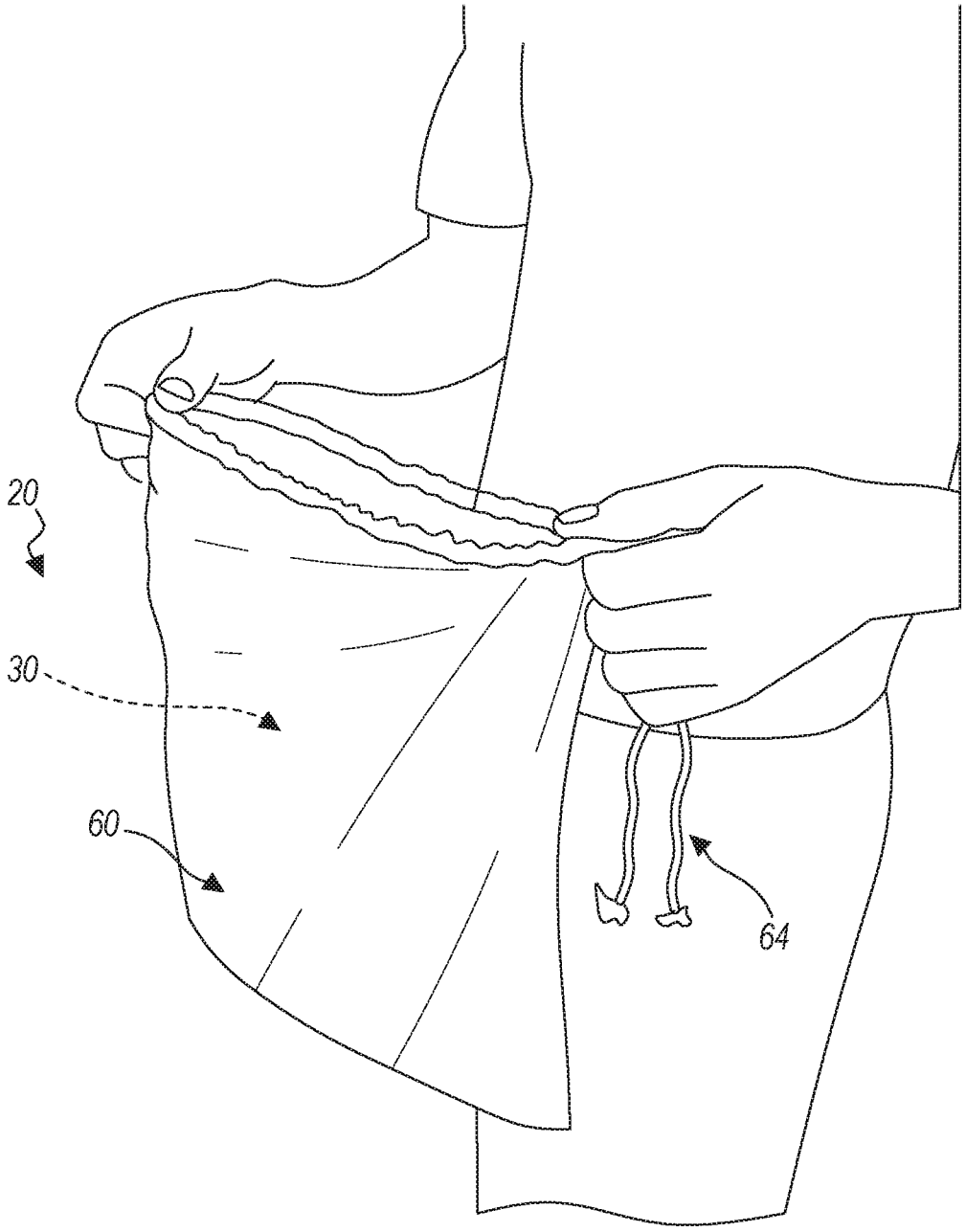
FIG. 11 is a diagrammatic perspective view of the fifth step of the method of self-packing the grooming-assisting device of the embodiments of the present invention.

The method of self-packing the grooming-assisting device 20 comprises the steps of:

STEP 1: As shown in FIG. 7, hold the grooming-assisting device 20 by the bottom edge 38 of the flexible sheet 36 of the substrate 30 upside down;

STEP 2: As shown in FIG. 8, flip the reinforcing member 52 of the substrate 30 back;

STEP 3: As shown in FIG. 9, reach into the pouch 60 of the substrate 30 and pull the pouch 60 of the substrate 30 inside out;

STEP 4: As shown in FIG. 10, put the flexible sheet 36 of the substrate 30 into the pouch 60 of the substrate 30; and STEP 5: As shown in FIG. 11, tighten the drawstring 64 of the pouch 60 of the substrate 30 and close the pouch 60 of the substrate 30.

G. Impressions

It will be understood that each of the elements described above, or two or more together, may also find a useful application in other types of constructions differing from the types described above.

While the embodiments of the present invention have been illustrated and described as embodied in a grooming-assisting device for replaceably attaching around the neck of a user, for replaceably attaching to a mirror used by the user, and for capturing facial hair clipped from the user for disposal, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features from the standpoint of prior art fairly constitute characteristics of the generic or specific aspects of the embodiments of the present invention.

What is claimed is:

1. A grooming-assisting device for replaceably attaching around the neck of a user, for replaceably attaching to a mirror used by the user, and for capturing facial hair clipped from the user for disposal, said grooming-assisting device comprising:

a) a substrate having a first end and a second, each of said first end and said second end having corners, wherein said substrate is for capturing the facial hair clipped from the user for disposal, and said substrate comprising a lightweight flexible sheet consisting essentially of a static and stick free material, said substrate having a greater width dimension at the second end thereof than at the first end thereof, and wherein the first end and second end are opposite to each other, wherein said flexible sheet comprises a lengthwise dimension formed by a pair of longitudinal extending side edges said side edges extending from the corners of said first end to the corners of said second end thereof bordering the lightweight flexible sheet, a first portion of each of said pair of side edges starting at the corners of said first end and extending in the direction of the corresponding corners of said second end, a second portion of each of said pair of side edges extending from the corners of said second end partially up the pair of side edges and meeting said first portion, said second portion comprising elastic material;

b) a first attaching apparatus on the first end, wherein said first attaching apparatus extends from said first end of said substrate for replaceably attaching said substrate around the neck of the user; and c) a second attaching apparatus on the second end, wherein said second attaching apparatus extends from said second end of said substrate for replaceably attaching said substrate to a mirror used by the user.

2. A method of catching facial hair clipped from a user, said method comprising the steps of:

a) providing a substrate said substrate having a top side, a bottom side, a first end, and a second end, each of said first end and said second end having corners, said substrate comprising a lightweight flexible sheet consisting essentially of a static and stick free material, said substrate having a greater width dimension at the second end thereof than at the first end thereof, and wherein the first end and second end are opposite to each other, wherein said flexible sheet comprises a lengthwise dimension formed by a pair of longitudinal extending side edges, said pair of side edges extending from the corners the first end to the corners of the second end bordering the lightweight flexible sheet, a first portion of each of said pair of side edges starting at the corners of said first end and extending in the direction of the corresponding corners of said second end and a second portion of each of said pair of side edges extending from the second end partially up the pair of side edges and meeting said first portion, said second portion comprising elastic material, said substrate having an aperture therein extending through said top and bottom sides and being positioned adjacent to said first end, said first end having a break therein extending through said first edge and through a perimeter of said aperture;

b) positioning a user's neck in said aperture;

c) providing a first attaching apparatus being attached to said substrate at said first end, said first attaching apparatus consisting of a first tab and a second tab, a closure being mounted on said tabs to releasably couple said tabs together, said closure including a first mating member attached the first tab and a second mating member attached to the second tab;

d) coupling said first tab and said second tab;

e) providing a second attaching apparatus being attached to said substrate at said second end;

f) attaching said second attaching apparatus to a mirror such that said substrate extends from said mirror to the user's neck and said substrate is positioned below the user's head to facilitate capturing of any facial hair clipped during shaving.

3. The method of claim 2, further comprising the step of securing the second attaching apparatus to the mirror wherein the second attaching apparatus further comprises a pair of lever-lock suction cups and wherein said pair of lever-lock suction cups have a pair of lever hooks, respectively.

4. The method of claim 3, further comprising the steps of:

a) uncoupling the first tab and the second tab;

b) removing the user's neck from the aperture; and c) wherein the first end of the substrate further comprises a pair of loops, coupling said pair of loops with said pair of lever hooks of said pair of lever-lock suction cups respectfully.

5. The method of claim 4, further comprising the step of removing the second attaching apparatus from the mirror.

* * * * *